US009212452B2

(12) United States Patent
Puckett, Sr.

(10) Patent No.: US 9,212,452 B2
(45) Date of Patent: Dec. 15, 2015

(54) IRONING BOARD

(71) Applicant: Matthew Tanner Puckett, Sr., Bristol, VA (US)

(72) Inventor: Matthew Tanner Puckett, Sr., Bristol, VA (US)

( * ) Notice: Subject to any disclaimer, the term of this patent is extended or adjusted under 35 U.S.C. 154(b) by 52 days.

(21) Appl. No.: 14/181,061

(22) Filed: Feb. 14, 2014

(65) Prior Publication Data

US 2015/0233046 A1 Aug. 20, 2015

(51) Int. Cl.

| | |
|---|---|
| ***D06F 81/04*** | (2006.01) |
| ***A47B 9/14*** | (2006.01) |
| ***A47B 27/14*** | (2006.01) |
| ***D06F 81/00*** | (2006.01) |

(52) U.S. Cl.

CPC ..... *D06F 81/003* (2013.01); *A47B 9/14* (2013.01); *A47B 27/14* (2013.01); *D06F 81/04* (2013.01)

(58) Field of Classification Search

CPC ..... A47B 27/14; A47B 9/00; A47B 9/02; A47B 9/04; A47B 3/002; A47B 9/14; A47B 2009/145; D06F 81/00; D06F 81/02; D06F 81/04; F16M 11/28

USPC ..... 38/103, 104; 248/188.1, 188.2, 188.5, 248/188.6; 108/6, 54.1, 116, 123, 147.19, 108/147.2

See application file for complete search history.

(56) References Cited

U.S. PATENT DOCUMENTS

| | | | | | |
|---|---|---|---|---|---|
| 858,969 | A * | 7/1907 | French | 108/168 |
| 911,149 | A * | 2/1909 | Moore | 108/148 |
| 1,209,150 | A * | 12/1916 | Hannold | 108/167 |
| 2,579,348 | A * | 12/1951 | Taylor | 248/178.1 |
| 3,043,440 | A * | 7/1962 | Berlin | 211/204 |
| 3,604,734 | A * | 9/1971 | Friedman et al. | 403/104 |
| 4,956,929 | A * | 9/1990 | Chirabandalsuk | 38/136 |
| 2013/0284077 | A1 * | 10/2013 | Copeland et al. | 108/117 |

* cited by examiner

*Primary Examiner* — Ismael Izaguirre

(74) *Attorney, Agent, or Firm* — Gulf Coast Intellectual Property Group

(57) ABSTRACT

An ironing board having a leg base operable to provide increased lateral stability and further having an integrated electrical interface. The ironing board includes a support frame having a center support member that is generally cylindrical and hollow. Slidably coupled to the second end of the center support member is a mounting sleeve. The mounting sleeve has pivotally secured thereto opposing and rotatable leg sections. An upper support member is slidably secured to the center support member proximate the first end of the center support member for height adjustment. The upper support member has secured thereto a mounting rod and sleeve. The mounting rod and sleeve are operably coupled with an ironing surface. An iron holding member is releasably secured to the upper support member being configured to retain a clothes iron. Further included is a hanging rod underneath the ironing surface for hanging of clothes.

19 Claims, 5 Drawing Sheets

IRONING BOARD

PRIORITY UNDER 35 U.S.C SECTION 119(e) & 37 C.F.R. SECTION 1.78

This nonprovisional application claims priority based upon the following prior U.S. Provisional Patent Application entitled: Ironing Board, Application No. 61/766,069 filed Feb. 18, 2013, in the name of Matthew Puckett, which is hereby incorporated by reference for all purposes.

FIELD OF THE INVENTION

The present invention relates to ironing boards, more specifically but not by way of limitation, an ironing board that is operable to provide increased lateral stability and further provide power cord management of a conventional clothes iron. Additionally, the ironing board of the present invention will provide a retention bracket for an iron that will not impede the ironing surface area.

BACKGROUND

As part of a normal caretaking routine, individuals routinely launder their clothes to maintain their cleanliness. During subsequent washing and drying of their clothes some fabrics may develop at least a certain amount of wrinkles Many individuals consider wrinkled clothes undesirable and will utilize an iron to substantially reduce the amount of wrinkles in the article of clothing. Most individuals will utilize a convention ironing board with an iron and manipulate the article of clothing in numerous positions to eliminate most of the wrinkles from the article of clothing.

There are numerous inherent problems with the conventional ironing board that has existed for decades. One major problem is the instability of a conventional ironing board. A conventional ironing board utilizes a pair of pivotal legs that are positioned in an angular manner with respect to each other in underneath and in general axial alignment with the ironing board. This design has shown to promote significant lateral instability. As the legs of a conventional ironing board do not extend beyond the perimeter edge of the board and with most ironing boards being at least four feet in height, the conventional design provides almost no lateral stability.

Another issue with conventional ironing boards is that they provide no cord management for the iron being used therewith. Typically a user will place the ironing board proximate an electrical outlet and plug in the iron. A conventional iron utilizes a power cord that provides power to the iron to heat the heating element. The cord presents a significant safety hazard to those using the ironing board or those walking proximate thereto. Users and/or those walking adjacent to the ironing board and iron often trip on the cord, which can cause significant injury to the individual who has become entangled with the cord. As a person trips on the cord the iron can fall off of the board and impact the person causing injuries ranging from burns to blunt trauma. Additionally, a falling iron can be a fire hazard and/or damage the flooring or nearby objects.

A further issue with a conventional ironing board is the lack of ability to maintain a controlled position of the iron superposed thereon. As a user manipulates the article of clothing being ironed the iron is typically placed on the opposite end of the board. As previously discussed, the inherent lack of lateral stability creates a scenario where the iron is routinely knocked off of the ironing board creating an additional safety hazard.

Accordingly, there is a need for an ironing board that has improved lateral stability, a power cord management system for an iron and a means to maintain the iron in a stable position when a user is manipulating an article of clothing on the ironing board or when the iron is left unattended.

SUMMARY OF THE INVENTION

It is the object of the present invention to provide an ironing board that provides lateral stability and further includes an integrated power supply.

Another object of the present invention is to provide an ironing board that provides lateral stability that includes a leg base wherein the leg base includes rotatably mounted members functioning to be positioned to provide enhanced lateral stability.

Yet another object of the present invention is to provide an ironing board that includes a leg base wherein one section of the leg base has a vertical support member perpendicularly mounted thereto.

Still another object of the present invention is to provide an ironing board that includes a leg base wherein the leg base is operable to be folded for storage when the ironing board is not in use.

An additional object of the present invention is to provide an ironing board including a vertical support member that is adjustable so as to adjust the height of the ironing board.

A further object of the present invention is to provide an ironing board that includes power cord management capabilities, wherein the power cord management capabilities are integrated into the vertical support member.

Yet a further object of the present invention is to provide an ironing board wherein the power cord management capabilities allow a user to operably couple the power plug of an iron into one end of the vertical support member.

Another object of the present invention is to provide an ironing board that includes a horizontal support member, wherein the horizontal support member is generally rod-shaped and is operably coupled to the vertical support member in a perpendicular manner.

A further object of the present invention is to provide an ironing board with improved lateral stability that includes a rod positioned longitudinally underneath the ironing board surface that is configured to receive items such as but not limited to clothes hangars.

Yet another object of the present invention is to provide an ironing board that includes an ironing surface, the ironing surface being planar in manner and rotatably coupled to the horizontal support member wherein the ironing surface is configured to be secured in a plurality of positions for use such as but not limited to a substantially horizontal position.

Still another object of the present invention is to provide an ironing board that is operably coupled to a power outlet wherein a cord is coupled to the power management system disposed within the vertical support member proximate the leg base.

An additional object of the present invention is to provide an ironing board that further includes an iron holding member, the iron holding member being pivotally mounted to the end of the vertical support member distal to the leg base and above the ironing surface and wherein the iron holding member is operable to retain the iron in a stable position as a user manipulates an article of clothing on the ironing surface.

To the accomplishment of the above and related objects the present invention may be embodied in the form illustrated in the accompanying drawings. Attention is called to the fact that the drawings are illustrative only. Variations are contemplated as being a part of the present invention.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
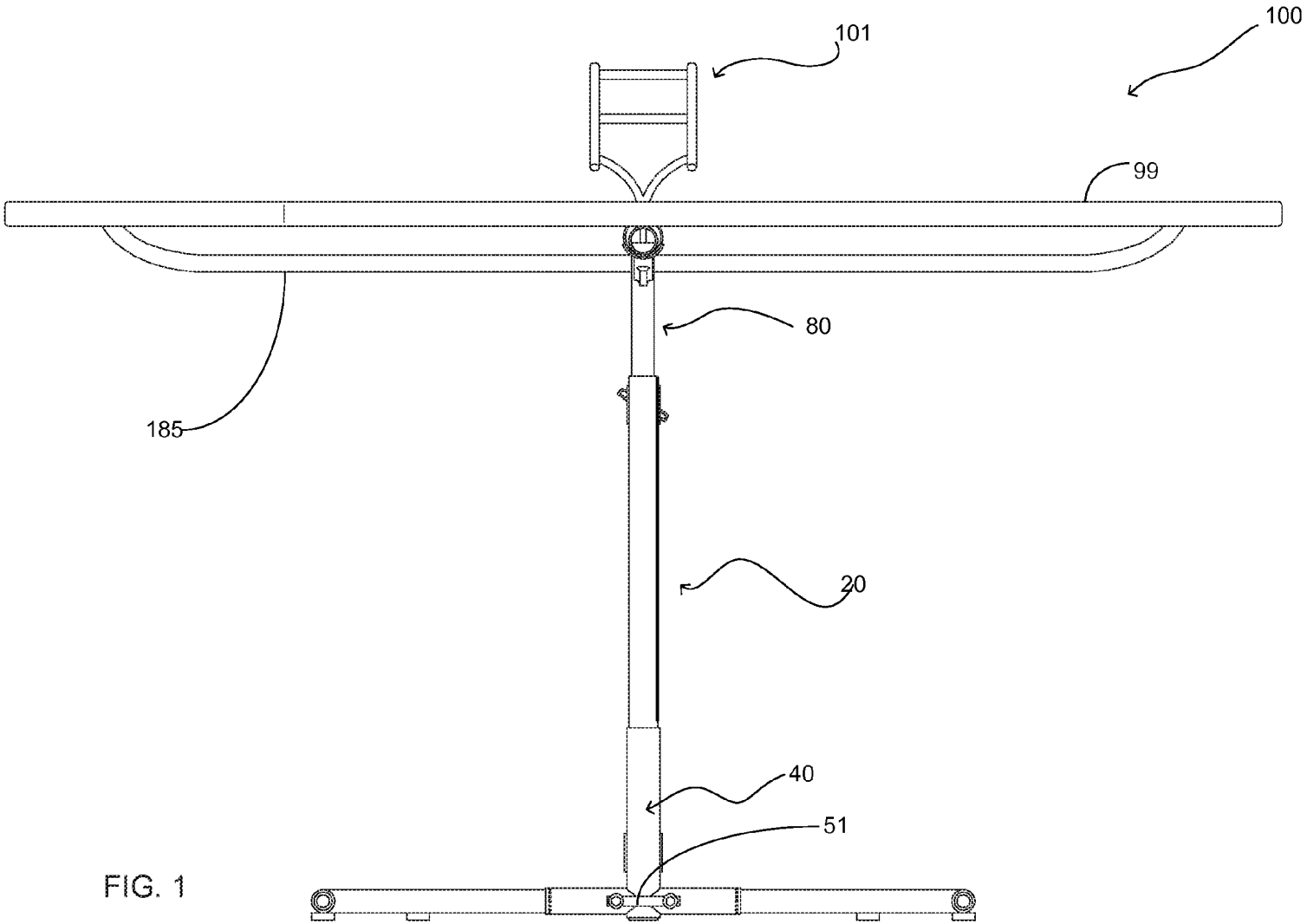
FIG. 1 is a front view of the preferred embodiment of the present invention in its deployed position.

Referring now to the drawings submitted herewith, wherein various elements depicted therein are not necessarily drawn to scale and wherein through the views and figures like elements are referenced with identical reference numerals, there is illustrated an ironing board 100 constructed according to the principles of the present invention.

Figure 4:
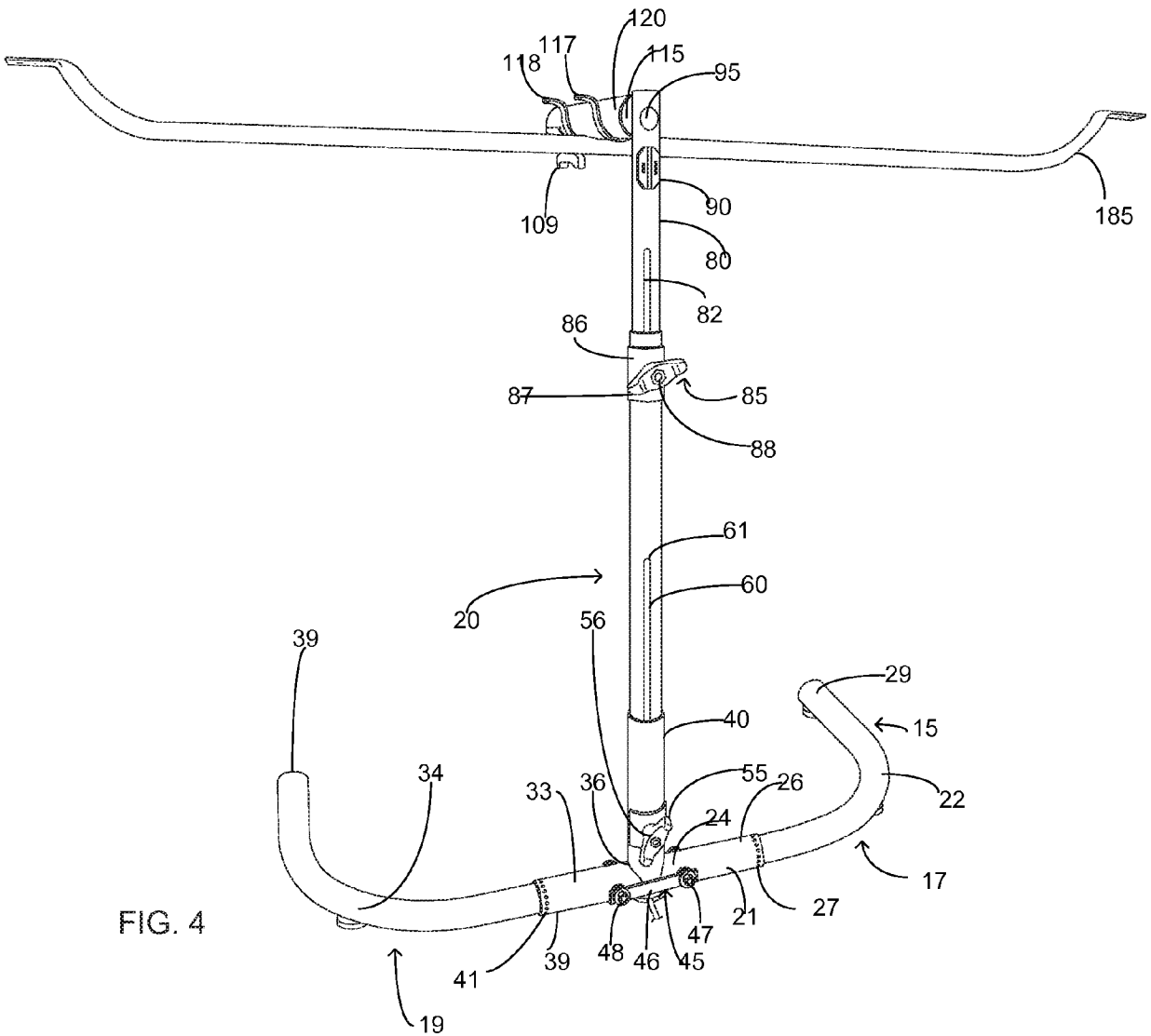
FIG. 4 is a rear perspective view of the frame of the present invention.

Referring in particular to FIG. 4 submitted herewith, the ironing board 100 further includes frame 10. The frame 10 is manufactured from a suitable durable material such as but not limited to metal tubing. The frame 10 functions to provide support for the ironing surface 99 and manipulate the ironing surface 99 intermediate a horizontal and a vertical position. The frame 10 further includes a leg base 15. The leg base 15 comprises a first portion 17 and a second portion 19 movably mounted to opposing sides of the center support member 20. The first portion 17 of the leg base includes a first section 21 and a second section 22. First section 21 is proximate the center support member 20 and is movably secured thereto. The first section 21 includes a first end 24 proximate the center support member 20. The first end 24 is concave in shape so as to mateably secure with the circumference of the center support member 20. The concave shape of the first end 24 ensures a stable union exists between the first section 21 and the center support member 20 when the leg base 15 is in its deployed position. Opposite first end 24 is second end 26. Second end 26 includes a plurality of apertures 27 journaled circumferentially therearound. Second end 26 facilitates the rotatable coupling of the first section 21 and the second section 22. While not particularly illustrated herein, disposed within the second section 22 is a conventional spring pin or similar device that is operable to engage with on of the apertures 27 to secure the second section 22 in its desired position to the first section 21. The second section 22 is rotatable one hundred and eighty degrees with respect to the first section 21. By way of example but not limitation, in FIG. 4 the second section 22 is illustrated wherein the end 29 is pointed away from the viewing perspective. The second section 22 is rotatable such that end 29 can be rotated one hundred and eighty degrees wherein end 29 would be pointed towards the viewing perspective. In this position the leg base 15 has an overall general s-shape, wherein the end 29 is positioned one hundred and eighty degrees opposite of end 39. In this position the overall ironing board 100 has significantly improved lateral stability in both directions.

Figure 5:
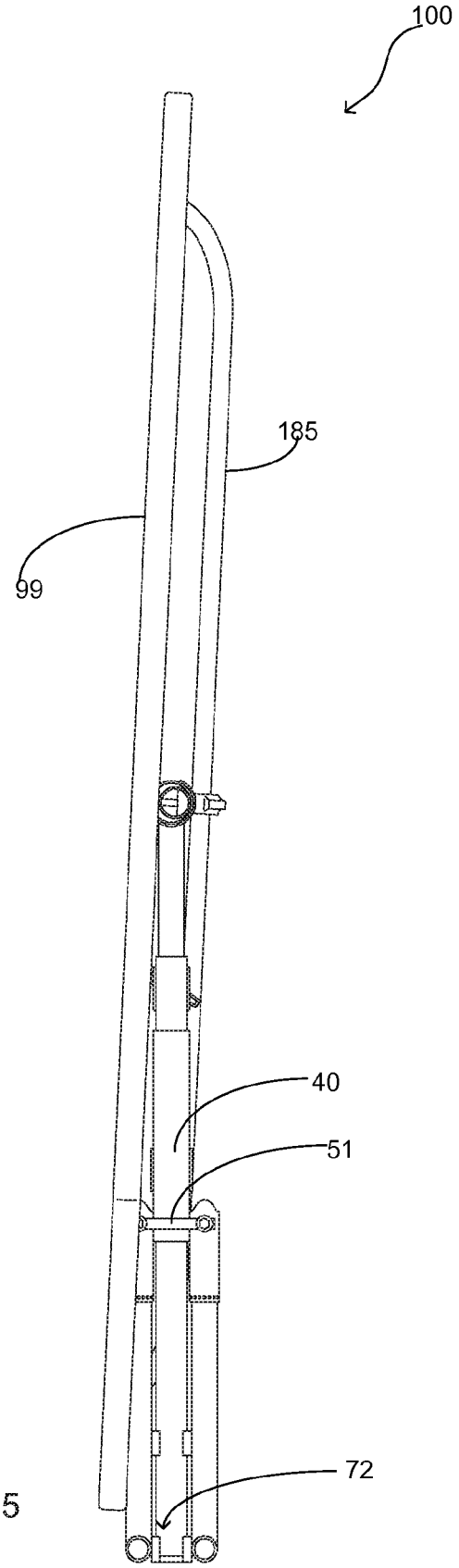
FIG. 5 is a side view of the preferred embodiment of the present invention in its folded position.

The second portion 19 of the leg base 15 is constructed similarly to the first portion 17 and functions identically thereto as described herein. The second portion 19 further includes first section 33 having first end 36 and second end 39 with both first end 36 and second end 39 being constructed similarly to first end 24 and second end 26 respectively. Second end 39 has journaled circumferentially therearound apertures 41 that are operable to receive spring pin or similar mechanical fastener so as to releasably secure the first section 33 to the second section 34. The first portion 17 and second portion 19 of the leg base are operably coupled to mounting sleeve 40 utilizing fastener 45. Fastener 45 includes bars 46,51, first rod 47 and second rod 48 operably coupled with first section 21 and first section 33 respectively. Bars 46,51 are secured to the mounting sleeve 40 utilizing suitable durable techniques such as but not limited to welding. The mounting sleeve 40 is surroundably mounted to the center support member 20 and slidably coupled thereto. Operably coupled to the mounting sleeve is knob 55 and rod 56 that function to allow the mounting sleeve to be moved intermediate its first position and its second position. The knob 55 and rod 56 are a conventional fastener that includes an inner portion such as but not limited to a nut that is operable to be biased against the interior of the center support member 20 so as to maintain the mounting sleeve 40 in its desired position. In its first position, the mounting sleeve 40 is proximate a support surface on which the ironing board 100 has been superposed and the first portion 17 and second portion 19 of the leg base 15 are in their deployed positions extending outward therefrom and generally perpendicular thereto, as shown in FIG. 4 herein. In its second position the mounting sleeve 40 is proximate the end 61 of channel 60 such that the first portion 17 and second portion 19 of the leg base 15 are in a folded position being generally adjacent to the center support member 20, as shown in FIG. 5 herein. The channel 60 functions to allow the rod 56 to slidably move therein as the mounting sleeve 40 is traversed intermediate its first position and its second position. Those skilled in the art will recognize that numerous types of fasteners could be utilized to facilitate the movement and securing of the mounting sleeve 40.

Figure 2:
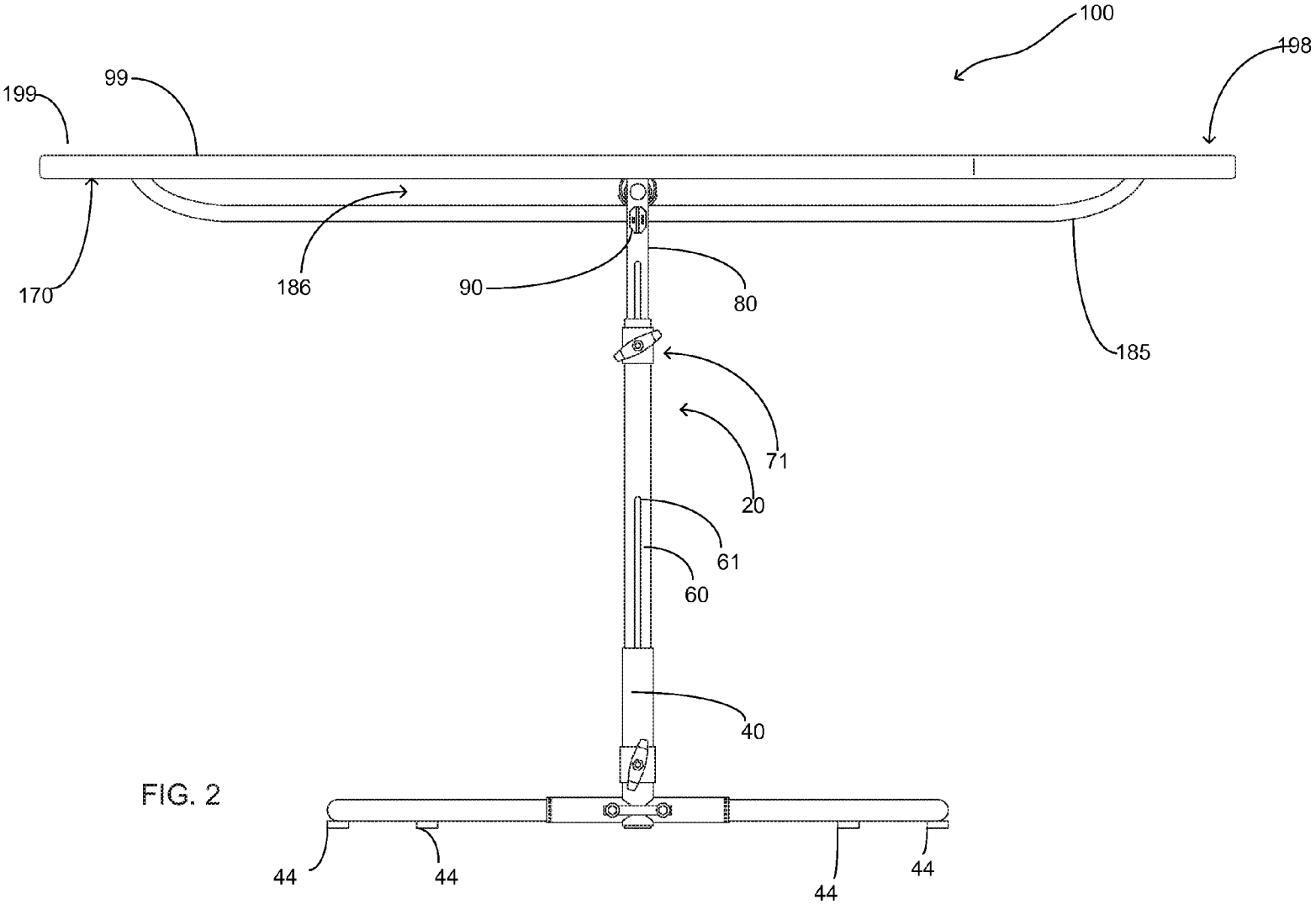
FIG. 2 is a rear view of the preferred embodiment of the present invention in its deployed position.

The center support member 20 is substantially hollow and manufactured from a durable rigid material such as but not limited to metal tubing. The center support member 20 includes first end 71 and second end 72. Mounting sleeve 40 is operably coupled to the center support member 20 proximate the second end 72 as previously described herein. Slidably coupled with the center support member 20 proximate first end 71 is tube member 80. Tube member 80 engages the center support member 20 such that the tube member 80 slidably travels within the interior volume of the center support member 20. Tube member 80 is substantially hollow and includes channel 82. Surroundably mounted to the first end 71 of the center support member 20 is fastener 85. Fastener 85 includes a mounting sleeve 86, knob 87 and rod 88. The fastener 85 facilitates the releasable securing of the tube member 80 in a desired position. The tube member 80 is operable to adjust the height of the ironing surface 99. Knob 87 is operable to control the tension of rod 88 so as to allow the tube member 80 to be transitioned to a desired position and subsequently secured. While a fastener 85 has been illustrated and discussed herein, it is contemplated within the scope of the present invention that numerous types of conventional fasteners could be utilized to control the functional of the tube member 80 as described herein. The tube member 80 further includes electrical outlet 90. Electrical outlet 90 is secured within the tube member 80 utilizing suitable durable techniques and is operable to receive a conventional 120/220-volt plug from a conventional clothes iron. While not illustrated herein, the electrical outlet 90 has conventional wiring electrically coupled thereto that is disposed within the center support member 20 and propagating out therefrom proximate end 72. The electrical outlet 90 functions to provide a power source proximate the ironing surface 99 so as to reduce challenges and safety risks of utilizing a power source that is not operably integrated with the ironing board 100. Located above the electrical outlet 90 is mounting hole 95. The mounting hole 95 is journaled through the tube member 80 and is operable to receive the mounting rod 105 of the iron support member 101 as further described herein. Secured to the tube member 80 opposite the mounting hole 95 is support bar 115. Support bar 115 is secured to tube member 80 utilizing suitable durable techniques and is generally perpendicular thereto. The support bar 115 provides the structural required to support the ironing surface 99. While not particularly illustrated herein, it is contemplated within the scope of the present invention that an additional support member could be secured intermediate the support bar 115 and tube member 80. Support bar 115 has rotatably mounted therearound a sleeve 120. The sleeve 120 is surroundably mounted to the support bar 115 and has secured thereon a pair of brackets 117,118. The brackets 117,118 operably coupled the sleeve 120 to the ironing surface 99 so as to facilitate in the positioning thereof. The sleeve 120 is operable to facilitate the positioning of the ironing surface 99 intermediate a vertical position as shown in FIG. 5 and a horizontal position as shown in FIG. 2. A wingnut 109 is present to releasably secure the sleeve 120 in a fixed position.

Figure 3:
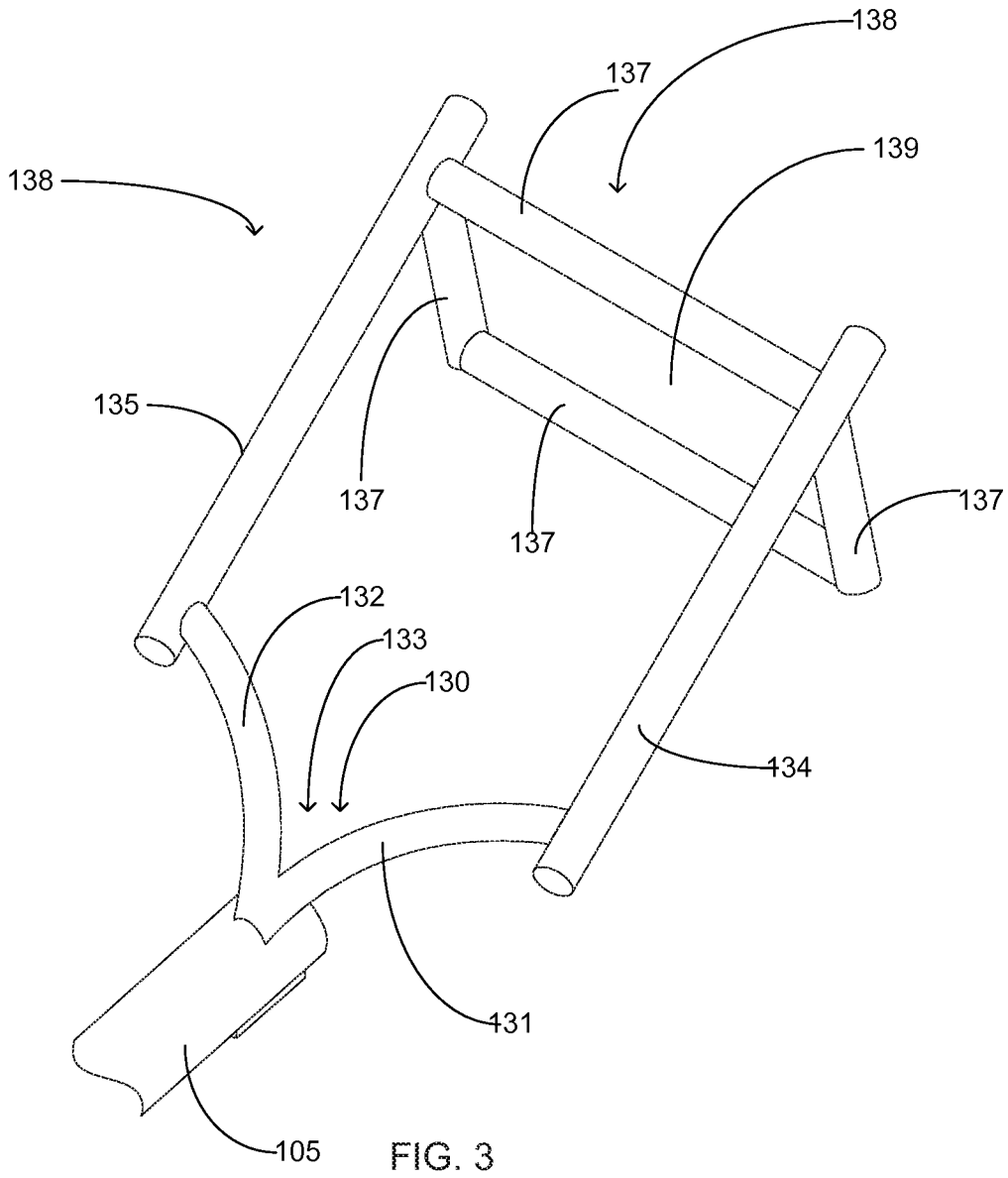
FIG. 3 is a detailed view of the iron holding member of the present invention.

Referring in particular to FIG. 3, a detailed view of the iron support member 101 is illustrated therein. The mounting rod 105 is manufactured from a suitable durable material and functions to operably coupled with mounting hole 95. Subsequent to being coupled to the mounting hole 95, the iron support member 101 is positioned such that it is laterally adjacent to the ironing surface 99. This position eliminates any infringement of the ironing surface 99 so as to provide the full ironing surface 99 to a user for ironing. Pivotally coupled to the mounting rod 105 is brace member 130. Brace member 130 is pivotally mounted utilizing conventional techniques such as but not limited to welding or mechanical fasteners. Brace member 130 further includes a first portion 131 and a second portion 132 that are contiguously formed. The first portion 131 and second portion 132 are formed in a general v-shape so as to form valley 133. The v-shape of the brace member 130 functions to promote engagement with the arcuate rear portion of a conventional clothes iron. Secured to the first portion 131 and second portion 132 are the first side member 134 and second side member 135 respectively. The first side member 134 and second side member 135 are generally rod-shaped and are secured utilizing suitable durable techniques such as but not limited to welding. Operably coupled intermediate the first side member 134 and second side member 135 is the receiving member 138. The receiving member 138 is comprised of four interconnected rods 137 forming a square aperture 139. The receiving member 138 is pivotally connected to the first side member 134 and second side member 135 so as to facilitate positioning of the square aperture 139 in position to receive a portion of the front of a conventional clothes iron and subsequently pivot so as to allow the rear portion of a conventional clothes iron to engage the brace member 130 wherein the weight of the conventional clothes iron provides the necessary bias force to maintain its position therein. Those skilled in the art will recognize that the iron support member 101 could be formed in numerous different shapes and accomplish the desired functionality herein. While not particularly illustrated herein, it is contemplated within the scope of the present invention that the iron support member 101 further includes a heat resistant coating thereon such as but not limited to silicon. Additionally, it is contemplated within the scope of the present invention that the iron support member 101 could be releasably and/or pivotally secured such that the iron support member 101 could be removed from and/or folded under the ironing surface 99.

The ironing surface 99 is a formed similarly to a conventional ironing surface having a first tapered end 198 and a flat end 199. The ironing surface 99 is manufactured from a suitable durable material such as but not limited to metal. Secured to the bottom side 170 of the ironing surface 99 is support bar 185. Support bar 185 is manufactured from a suitable durable material such as but not limited to metal and is secured utilizing suitable durable techniques intermediate tapered end 198 and flat end 199. The support bar 185 is secured such that a void 186 is present intermediate the bottom side 170 and the support bar 185. While no particular size of the void 186 is required, good results have been achieved having a void that is sufficient in size so as to accommodate a hook portion of a conventional clothes hangar. The support bar 185 provides support for a plurality of articles of clothing suspended on conventional clothes hangars. While the support bar 185 is illustrated herein as extending substantially the length of the ironing surface 99, it is contemplated within the scope of the present invention that the support bar 185 could be manufactured in numerous different lengths.

Referring to the Figures herewith a description of the operation of the ironing board is as follows. In operation, a user will transition the ironing board 100 from its stored position, shown in FIG. 5 to its deployed position, illustrated herein in FIG. 2. To deploy the leg base 15, a user will engage knob 55 to release the tension to the mounting sleeve 40 wherein the user will slide the mounting sleeve 40 towards end 72 of the center support member 20. As the leg base 15 is transitioned downward the first portion 17 and second portion 19 move outwards from the center support member 20. During this movement the concave shaped first end 24 and first end 36 mateably secure against the center support member 20 as the first portion 17 and second portion 19 are moved such that they are perpendicular to the center support member 20. Ensuing the tightening of knob 55 to secure the leg base 15, the user will rotate the ironing surface 99 to a substantially horizontal position wherein the sleeve 120 facilitates the rotatable movement about the support bar 115. Subsequent to positioning the ironing surface 99 and securing its position, the iron support member 101 is placed adjacent thereto wherein the mounting rod 105 is journaled into mounting hole 95. A conventional clothes iron is then engaged with the iron support member 101 and electrically coupled with the electrical outlet 90. If the user desires an alternative configuration of the leg base 15 so as to alter the lateral stability, the user may rotate either the second section 22 or second section 34 such that the leg base 15 is now formed in a general s-shape.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An ironing board comprising:

an ironing surface, said ironing surface being planar in manner, said ironing surface having a first end and a second end, said ironing surface having an upper surface and a lower surface;

a support frame, said support frame further including a center support member, said center support member having a first end and a second end, said first end being proximate said ironing surface, said center support member being cylindrical in shape and substantially hollow, said support frame further including a mounting sleeve, said mounting sleeve being surroundably mounted to said center support member proximate said second end, said mounting sleeve operable to slidably traverse along a portion of said center support member, said support frame further including an upper support member, said upper support member being movably coupled with said center support member proximate said first end, said upper support member operably coupled with said ironing surface, said upper support member movable so as to provide height adjustment for said ironing surface;

a leg base, said leg base being movable secured to said mounting sleeve, said leg base having a first portion and a second portion, said first portion and said second portion being cylindrical in shape, said first portion and said second portion being secured to opposing sides of said mounting sleeve, said leg base having a first position and a second position; and wherein said first portion further includes a first section and a second section, said second section being rotatably mounted to said first section, said second section having a radius thereto.

2. The ironing board as recited in claim 1, wherein said second portion further includes a first section and a second section, said second section of said second portion being rotatably coupled to said first section of said second portion, said second section of said second portion being formed in an arcuate shape.

3. The ironing board as recited in claim 2, wherein said upper support member further includes an ironing surface support member, said ironing surface support member having a sleeve therearound, said sleeve being rotatably mounted, said sleeve being operably coupled with the lower surface of said ironing surface.

4. The ironing board as recited in claim 3, and further including an iron holding element, said iron holding element releasably coupled to said upper support member, said iron holding element having an aperture so as to receive a portion of a conventional clothes iron.

5. The ironing board as recited in claim 4, and further including an electrical interface, said electrical interface secured to said upper support member, said electrical interface operable to electrically couple with an electrical cord plug of a conventional clothes iron.

6. The ironing board as recited in claim 5, and further including a hanging rod, said hanging rod being secured to the lower surface of said ironing surface, said hanging rod extending at least a portion of the ironing surface, said hanging rod configured to receive thereon a conventional clothes hangar.

7. An ironing board configured to have increased lateral stability comprising:

an ironing surface, said ironing surface being planar in manner, said ironing surface having a first end and a second end, said ironing surface having an upper side and a lower side;

a support frame, said support frame further including a center support member, said center support member having a first end and a second end, said first end being proximate said ironing surface, said center support member being cylindrical in shape and substantially hollow, said center support member further including a channel, said channel being proximate said second end, said support frame further including a mounting sleeve, said mounting sleeve being surroundably mounted to said center support member proximate said second end, said mounting sleeve further having a mounting bracket wherein the mounting bracket further including a bolt member, said bolt member operably engaged with said channel of said center support member, said mounting sleeve operable to slidably traverse along a portion of said center support member wherein said bolt member being operable to restrict vertical movement of said mounting sleeve as said bolt member is confined within said channel, said support frame further including an upper support member, said upper support member including a first end and a second end, said upper support member being movably coupled with said center support member proximate said first end, said upper support member further including a slot, said upper support member operably coupled with said ironing surface, said upper support member movable so as to provide height adjustment for said ironing surface, said slot operable to provide limitation of vertical movement of said upper support member;

a leg base, said leg base being movable secured to said mounting sleeve, said leg base having a first portion and a second portion, said first portion and said second portion being cylindrical in shape, said first portion and said second portion being secured to opposing sides of said mounting sleeve, said leg base having a first position and a second position, said first portion and said second portion of said leg base being perpendicular to said center support member subsequent said leg base being placed in said second position.

8. The ironing board as recited in claim 7, wherein said upper support member further includes a mounting rod, said mounting rod being perpendicularly secured to said upper support member proximate said first end, said mounting rod having a rotatable sleeve therearound, said rotatable sleeve being coupled with the lower side of said ironing surface, said rotatable sleeve operable to move the ironing surface intermediate a first position and a second position.

9. The ironing board as recited in claim 8, and further including an iron holding member, said iron holding member being releasably secured to said upper support member, said iron holding member including a bottom support bar, said bottom support bar having a first segment and a second segment, said bottom support bar being generally v-shaped.

10. The ironing board as recited in claim 9, wherein said first portion of said leg base includes a first section and a second section, said first section having a first end and a second end, said first section being proximate said center support member, said second section being rotatably secured to said first section, wherein said second section is rotatable with respect to said first section approximately one hundred and eighty degrees.

11. The ironing board as recited in claim 10, wherein said second portion of said leg base includes a first section and a second section, said first section having a first end and a second end, said first section of said second portion being proximate said center support member, said second section of said second portion being rotatably mounted to said first section of said second portion, said second section of said second portion being rotatable approximately one hundred and eighty degrees with respect to said first section of said second portion.

12. The ironing board as recited in claim 11, and further including an electrical interface, said electrical interface being mounted within said upper support member proximate said first end, said electrical interface operable to electrically couple with a electrical plug of a conventional clothes iron.

13. The ironing board as recited in claim 12, wherein said second end of said first section of said first portion and said first section of said section portion include a plurality of apertures, said plurality of apertures operable to assist in the positioning of said second section.

14. An ironing board configured to having increased lateral stability and provide electrical cord management of a conventional clothes iron comprising:

an ironing surface, said ironing surface being planar in manner, said ironing surface having a first end and a second end, said ironing surface having an upper side and a lower side, said ironing surface having a first lateral edge and a second lateral edge;

a support frame, said support frame further including a center support member, said center support member having a first end and a second end, said first end being proximate said ironing surface, said center support member being cylindrical in shape and substantially hollow, said center support member further including a channel, said channel being proximate said second end, said support frame further including a mounting sleeve, said mounting sleeve being surroundably mounted to said center support member proximate said second end, said mounting sleeve further having a mounting bracket wherein the mounting bracket further includes a bolt member, said bolt member operably engaged with said channel of said center support member and wherein said bolt member functions to limit vertical travel of said mounting sleeve, said mounting sleeve operable to slidably traverse along a portion of said center support member adjacent to said channel, said support frame further including an upper support member, said upper support member including a first end and a second end, said upper support member being cylindrical in shape and substantially hollow, said upper support member having a diameter that is les than that of said center support member, said upper support member being slidably inserted into said center support member, said upper support member being movably coupled within said center support member proximate said first end, said upper support member further including a slot, said slot being proximate said second end, said slot operably coupled with a mounting assembly, said mounting assembly configured to control the movement of said upper support movement, said mounting assembly operably coupled to said slot and said upper support member, said upper support member having a support bar, said support bar being perpendicular to said upper support member, said upper support member movable so as to provide height adjustment for said ironing surface, said slot operable to provide limitation of vertical movement of said upper support member;

a leg base, said leg base being movable secured to said mounting sleeve, said leg base having a first portion and a second portion, said leg base further including a mounting bracket pivotally coupling said first portion and said second portion to said mounting sleeve, said first portion and said second portion being cylindrical in shape, said first portion and said second portion being secured to opposing sides of said mounting sleeve, said leg base having a first position and a second position, said first portion and said second portion of said leg base being perpendicular to said center support member subsequent said leg base being placed in said second position.

15. The ironing board as recited in claim 14, and further including an iron holding member, said iron holding member being releasably secured to said upper support member, said iron holding member including a bottom support bar, a pair of side support members and an upper support bar integrally formed to create a square aperture, said iron holding member further including a receiving member, said receiving member being pivotally mounted intermediate said pair of side support members, said receiving member operable to receive a portion of a front end of a conventional clothes iron, said bottom support bar having a first segment and a second segment, said bottom support bar being generally v-shaped so as to receive the rear portion of a conventional clothes iron.

16. The ironing board as recited in claim 15, and further including an electrical interface, said electrical interface being mounted within said upper support member proximate said first end, said electrical interface operable to electrically couple with a electrical plug of a conventional clothes iron.

17. The ironing board as recited in claim 16, wherein said first portion of said leg base includes a first section and a second section, said first section having a first end and a second end, said first section being proximate said center support member, said second section being rotatably secured to said first section, wherein said second section is rotatable with respect to said first section approximately one hundred and eighty degrees.

18. The ironing board as recited in claim 17, wherein said second portion of said leg base includes a first section and a second section, said first section having a first end and a second end, said first section of said second portion being proximate said center support member, said second section of said second portion being rotatably mounted to said first section of said second portion, said second section of said second portion being rotatable approximately one hundred and eighty degrees with respect to said first section of said second portion.

19. The ironing board as recited in claim 18, and further including a hanging rod, said hanging rod being secured to the lower surface of said ironing surface, said hanging rod extending at least a portion of the ironing surface, said hanging rod configured to receive thereon a conventional clothes hangar.

* * * * *